US005794643A

United States Patent [19]

Brice

[11] Patent Number: 5,794,643

[45] Date of Patent: Aug. 18, 1998

[54] PRESSURE REGULATED DIVERTING APPARATUS AND METHOD FOR WATER CONSERVATION

[76] Inventor: John L. Brice, 911 Almadin, San Antonio, Tex. 78258

[21] Appl. No.: 553,081

[22] Filed: Nov. 3, 1995

[51] Int. Cl.[6] ..... F24H 1/00

[52] U.S. Cl. ..... 137/14; 137/337; 137/563; 137/892; 126/362

[58] Field of Search ..... 126/362; 137/337, 137/563, 892, 888, 14

[56] References Cited

U.S. PATENT DOCUMENTS

| | | | |
|---|---|---|---|
| 3,322,151 | 5/1967 | Giese et al. | 137/888 |
| 3,776,261 | 12/1973 | Houghton | 137/337 |
| 3,870,228 | 3/1975 | Mosely, Jr. | 126/362 |
| 3,885,584 | 5/1975 | Hock | 137/334 |
| 4,201,518 | 5/1980 | Stevenson | 417/12 |
| 4,648,426 | 3/1987 | Oberholtzer | 126/362 |
| 4,673,006 | 6/1987 | Speck | 137/882 |
| 4,697,614 | 10/1987 | Powers et al. | 137/337 |
| 4,738,280 | 4/1988 | Oberholtzer | 126/362 |
| 4,750,472 | 6/1988 | Fazekas | 417/12 |
| 4,922,943 | 5/1990 | Gill | 137/1 |
| 4,924,536 | 5/1990 | Houghton | 4/665 |
| 4,936,289 | 6/1990 | Peterson | 126/362 |
| 4,959,526 | 9/1990 | Kurachi et al. | 126/362 |
| 5,009,572 | 4/1991 | Imhoff et al. | 417/32 |
| 5,105,846 | 4/1992 | Britt | 137/337 |
| 5,165,456 | 11/1992 | Woolman | 4/625 |
| 5,206,963 | 5/1993 | Wiens | 4/603 |
| 5,339,859 | 8/1994 | Bowman | 137/337 |
| 5,393,228 | 2/1995 | Policicchio | 4/597 |
| 5,459,890 | 10/1995 | Jarocki | 126/362 |
| 5,564,462 | 10/1996 | Storch | 137/563 |

*Primary Examiner*—A. Michael Chambers
*Attorney, Agent, or Firm*—Shafer & Culbertson; J. Nevin Shaffer, Jr.

[57] ABSTRACT

A pressure regulated diverting system (10) for water conservation includes a vacuum flow device (12), a diversion line (14), a regulating valve (16), and a containment device (18). The vacuum flow device (12) is inserted in line with the main hot water supply line (20) with a third opening connected to the diversion line (14) which passes through regulating valve (16) and is connected to containment device (18). When regulating valve (16) is open, the cooled hot water slug contained in the hot water supply line (20) fills containment device (18). Once full, the diversion line (14) and the hot water supply lines (20) are pressure equalized and, with the cold water slug, that is normally wasted, removed, hot water is available at the faucet (58) or shower head (60) essentially immediately. A smaller version for use within a shower, in particular, is available and utilizes a manually operable regulating valve (16) to force the first cold slug of cooled hot water into containment device (18). Once full, as can be determined by visual observation, regulating valve (16) is opened and hot water is immediately at shower head (60) while the cold hot water slug is gradually siphoned back into the water flow and used, not wasted.

20 Claims, 5 Drawing Sheets

PRESSURE REGULATED DIVERTING APPARATUS AND METHOD FOR WATER CONSERVATION

BACKGROUND OF THE INVENTION

This invention relates to an improved pressure regulated diverting apparatus and method for water conservation for use in systems where hot and cold water lines are available.

A variety of methods have been devised to attempt to solve the problem faced by millions every day when it comes to utilizing hot water. In a typical situation where a hot and cold water line are both available, the utilization of the hot water line requires the expulsion of cooled hot water prior to the heated hot water reaching the outlet. The standard solution has been to simply turn the hot water faucet on and let the water run until hot water actually reaches the outlet. The same is true for showers. Clearly, this is an extravagance whose time has come to an end. As the need for, and value of, fresh potable water grows nation and world wide, it is no longer tolerable to accommodate such a waste of water.

This problem, recognized before now, but growing, continues without a satisfactory solution. Prior art solutions have been as simple as to run the cooled hot water into a bucket, saving the bucket of potable water for other use, presumably. Additionally, there have been a variety of complicated valves and costly piping arrangements which are not commercially viable and which do not totally address the entire market since they are not easily retrofittable into existing homes and facilities.

Thus, there is a need in the art for providing a diverting apparatus and method for water conservation which is simple and effective in design and performance; which is easily retrofittable; and which is capable of slight modifications to accommodate a variety of uses. It is, therefore, an object of this invention to provide an improved diversion system for water conservation which will enable a user to obtain hot water from the hot water faucet substantially instantly upon turning on the hot water faucet and which does not waste the slug of cooled hot water that has been diverted.

SUMMARY OF THE INVENTION

Accordingly, the pressure regulated diverting system of the present invention includes a vacuum flow device inserted into a hot water supply line connected to a diversion line with two ends. Another end of the diversion line is connected to a regulating valve and the regulating valve is connected to a containment device. In a preferred embodiment, the vacuum flow device includes a Tee fitting with two aligned openings connected in line with the hot water supply line. The Tee fitting also has a third opening, perpendicular to the two aligned openings (thus forming the "T") which is connected to the diversion line. The diversion line is conformed to be smaller than, and fit in spaced apart relation within, the third opening and one of the two aligned openings. Further, again, in a preferred embodiment, the diversion line includes a short section extending within and beyond one of the two aligned openings in the Tee fitting and a flared end on the short section. The flared end results, because of water flowing away from the hot water supply and around and over the flared end, in a suction on the diversion line. Also, water flowing toward the hot water supply line is captured by and enters the flared end of the diversion line which then directs the water to the containment device. The valve, in its simplest form, includes a manual on/off handle for operation. In other preferred embodiments, electrical/mechanical and pneumatic operation of the regulating valve is utilized. Still further, the containment device contains an air vent which allows air egress and ingress to the containment device and a closure system for closing the air vent when the container is full of the cooled hot water. In a preferred embodiment, the closing device consists of a ping-pong ball which is raised by the water entering the containment device until such time as the ping-pong ball is pressed against the air vent to seal it. At this point, the sealed container results in equalized pressure in the diversion line as in the rest of the hot water supply line. A further embodiment includes a float switch which transmits a signal to the regulating valve when the container is empty.

In operation, the regulating valve is positioned so that, while the outlet faucet, shower head, and the like, is left closed, water is diverted by the flared end in the diversion line through the regulating valve and into the containment device. When the containment device is full and sealed against further water introduction, the pressure in the system will be equalized and the slug of cooled hot water will have been removed from the lines. At that point, the outlet is opened, the faucet or shower turned on, etc., and immediately or shortly thereafter heated water from the hot water heater flows from the outlet. While the shower is being operated, hot water from the hot water supply line is flowing over the flared end of the diversion line thereby creating a suction on the containment device. In less than a minute, the water is emptied from the containment device and blended with the hot water in the supply line so that it is utilized and not wasted. Once the containment device is emptied the regulating valve is manipulated so that the device is ready for future use.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENTS

Figure 1:
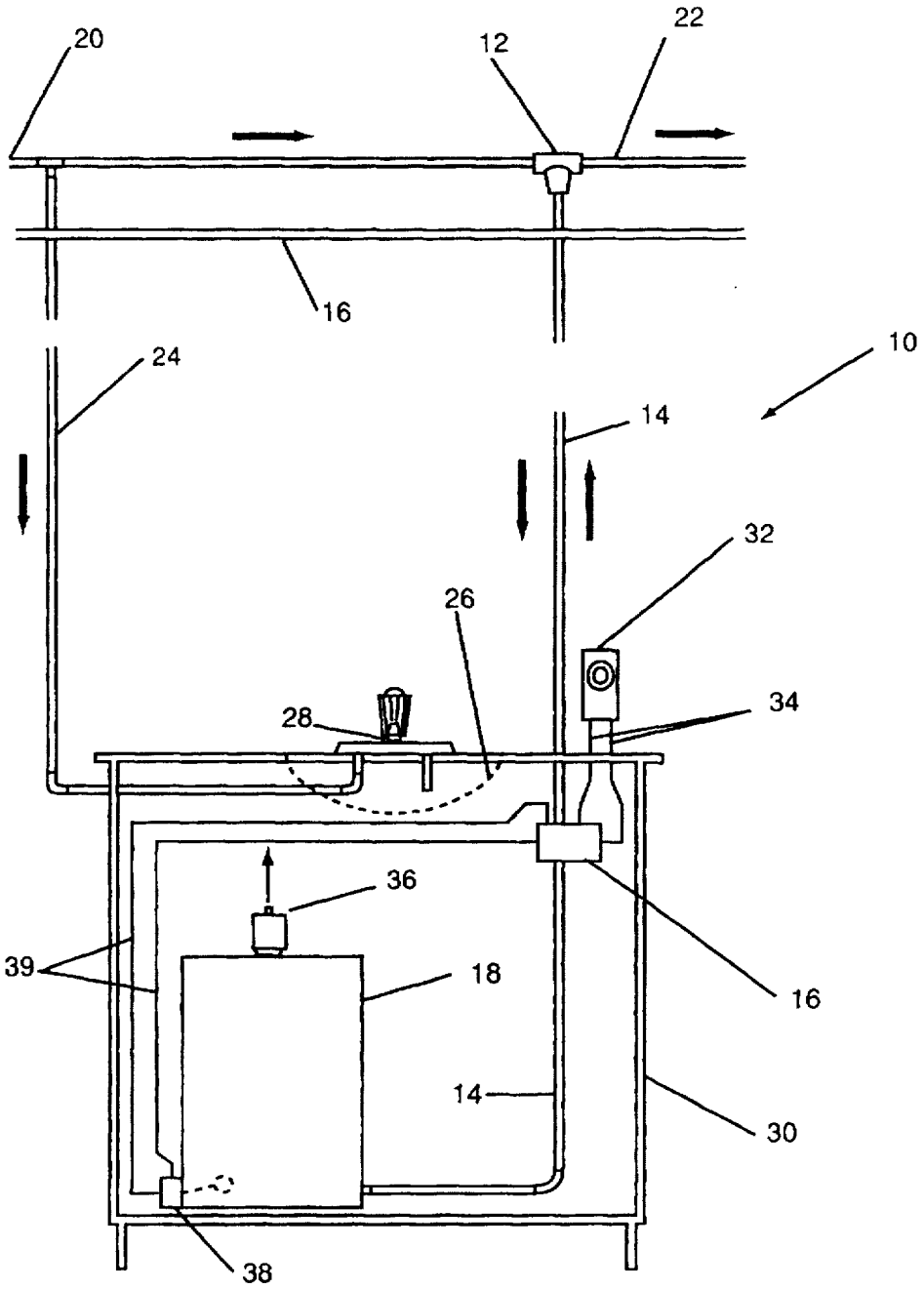
FIG. 1 is a front view of a preferred embodiment of the pressure regulated diverting system for water conservation of the present invention with the cabinet structure of a typical bathroom being cut away to reveal the location of parts of the invention within the cabinet.

The preferred embodiment of the present invention is illustrated by way of example in FIGS. 1–8. With specific reference to FIGS. 1 and 2, a pressure regulated diverting system for water conservation 10 includes vacuum flow device 12, diversion line 14, regulating valve 16 and containment device 18.

Also shown in FIG. 1 are main hot water supply line 20 from the hot water heater (not shown), the main hot water supply line 22 after vacuum flow device 12 which continues on to shower, tub, other faucets, and outlets (not shown), hot water supply 24 to bathroom sink 26 (shown in dotted lines), and hot water faucet 28 located on bathroom cabinet 30.

FIG. 1 also shows switch 32 connected to regulating valve 16 by means of control wiring 34. Further, containment device 18 includes automatic air vent 36 and float switch 38 (shown in dotted lines inside containment device 18) connected to regulating valve 16 by means of control wiring 39.

Figure 2:
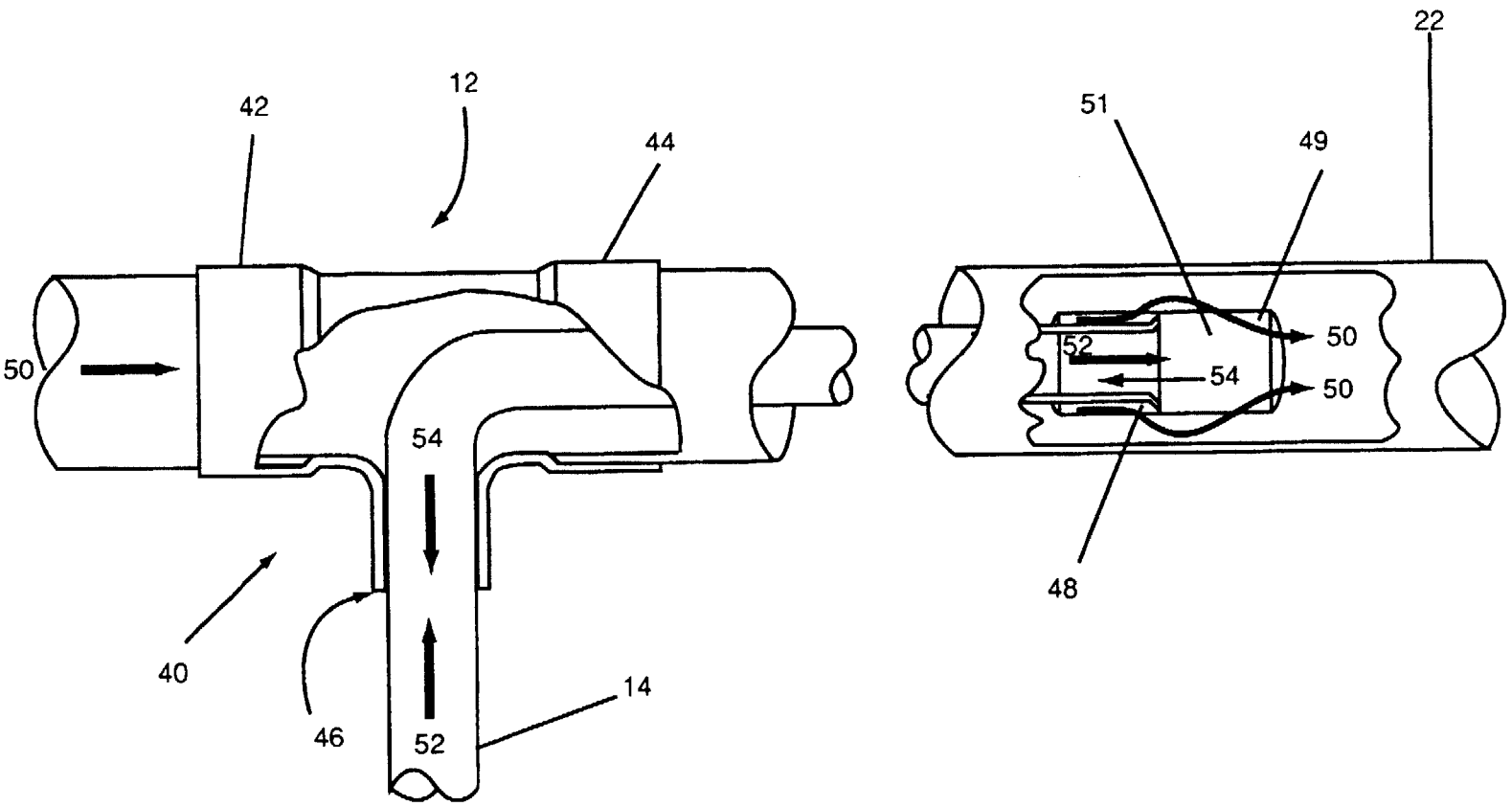
FIG. 2 is a side view of the Tee fitting of the present invention, partially cut away to reveal the diversion line of the invention in FIG. 1.

Referring now to FIG. 2, vacuum flow device 12 consists of a standard Tee fitting 40 with two aligned openings 42 and 44 and a third opening 46 through which diversion line 14 passes. As shown in FIG. 2, diversion line 14 is connectedly sealed within third opening 46 then bends within main hot water supply line 20 in the direction of the normal flow of the hot water supply line towards and within hot water supply line 22.

FIG. 2 also illustrates flared end 48 of diversion line 14 and the fact that diversion line 14 is located within main hot water supply line 22 after vacuum flow device 12 in a spaced apart relation so that water, as indicated by arrows 50, can flow around and over and past flared end 48. Flared end 48 is also shown enclosed within a section sleeve 49. Section sleeve 49 is fitted over flared end 48 so that water flows within section sleeve 49 and around flared end 48. As will be disclosed more fully hereafter, this flow of water in the direction of arrows 50 creates negative pressure in area 51 which causes a suction on diversion line 14 at flared end 48 drawing water in the direction of arrow 52 from containment device 18, and routing through an opened regulating valve 16. Likewise, when regulating valve 16 is open and no water is flowing along supply line 22, water will back up and enter flared end 48 in the direction of arrow 54 so as to fill containment device 18.

Figure 3:
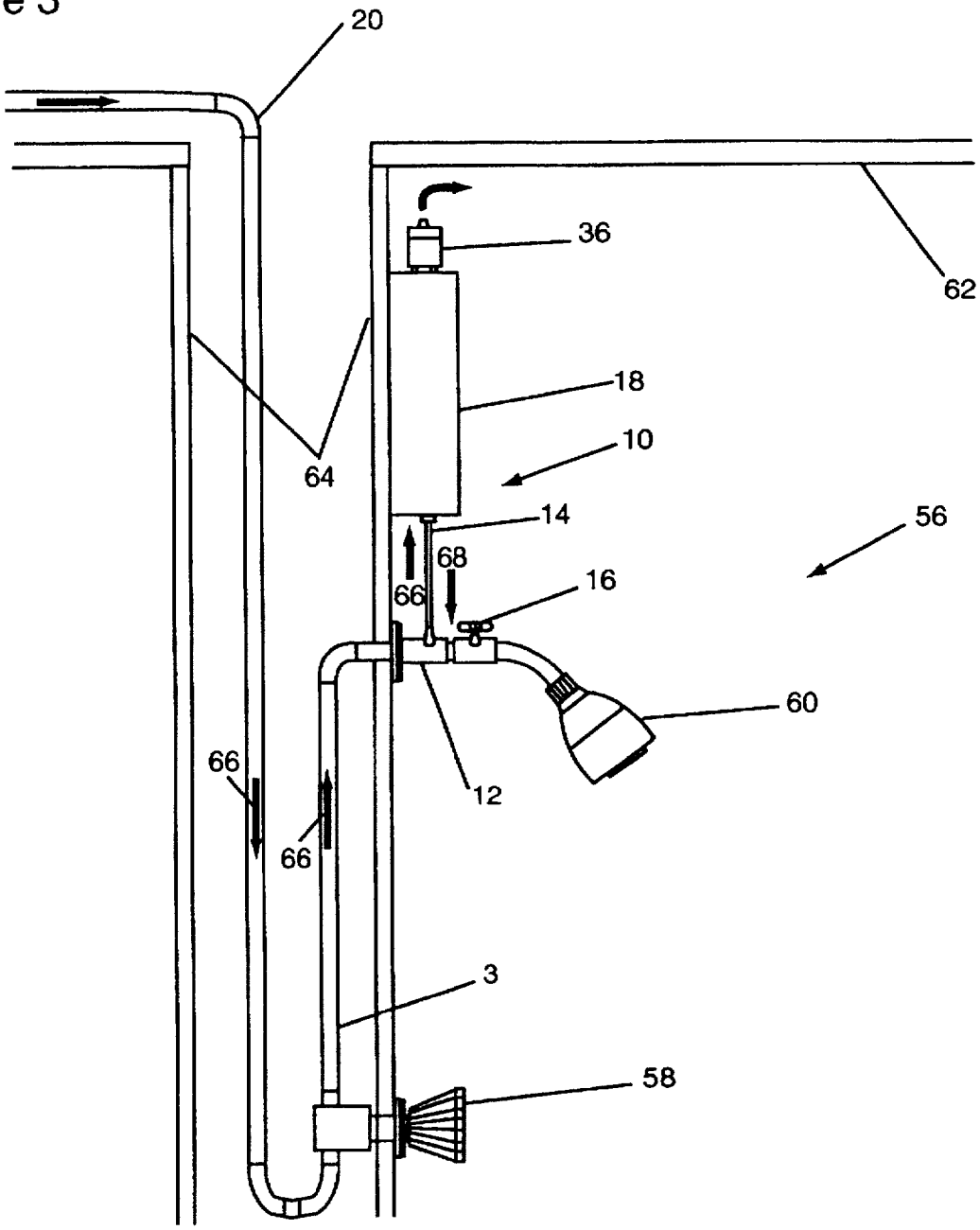
FIG. 3 is a side view of another preferred embodiment of the invention.

Referring now to FIG. 3, another embodiment of the present invention is disclosed. In this embodiment shower 56 includes main hot water supply line 20 connected to standard hot/cold faucet 58 to shower head 60. In this embodiment vacuum flow device 12 is connected after faucet 58 and before shower head 60 in hot water supply line 20. Diversion line 14 connects vacuum flow device 12 directly with containment device 18, which also includes automatic air vent 36. Regulating valve 16 is located between vacuum flow device 12 and shower head 60.

FIG. 3 also shows the outline of shower 56 including ceiling 62 and plumbing chase walls 64.

Figure 4:
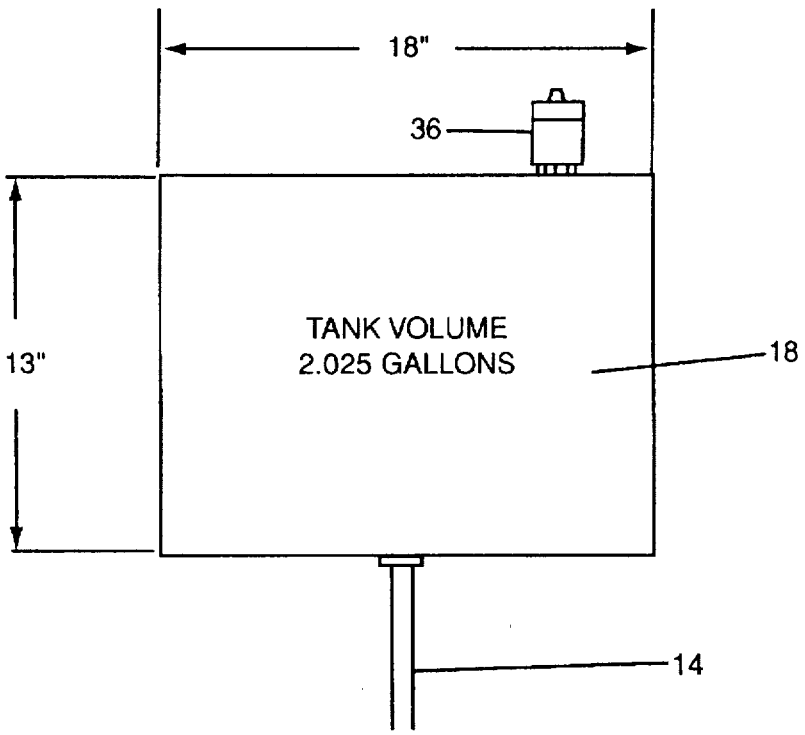
FIG. 4 is a front view of a container of a preferred embodiment of the invention in FIG. 3.
Figure 5:
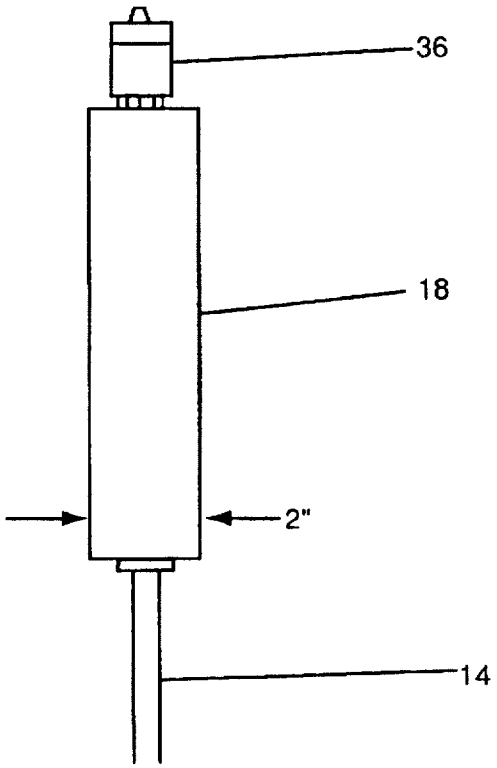
FIG. 5 is a side view of the container in FIG. 4.

Referring now to FIGS. 4 and 5, the preferred embodiment of pressure regulated diverting system for water conservation 10 illustrated in FIG. 3, shows a front view (FIG. 4) and a side view (FIG. 5) of containment device 18. In this embodiment, containment device 18 is much wider than it is thick. In a preferred embodiment, the containment device 18 is 18" wide by 13" tall and 2" thick. The containment device 18 in this embodiment contains approximately 2.0 gallons of cooled hot water.

Figure 6:
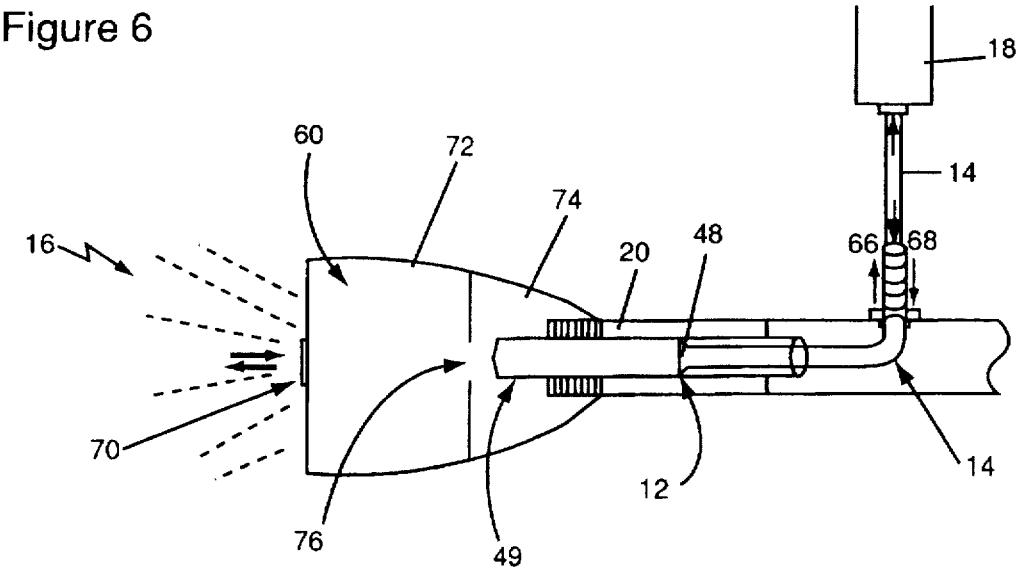
FIG. 6 is a side section of another preferred embodiment of the present invention.

Referring now to FIG. 6, another preferred embodiment of the invention is illustrated. In this embodiment, regulating valve 16 consists of push button mechanism 70 where if the button is pushed in, water flow is stopped and where the button is out, water flow is permitted. Shower head 60 is shown with main shower head body 72 and pre-shower head chamber 74 with orifice 76 connecting pre-shower head chamber 74 with main shower head body 72. By means of this embodiment, pushing in push button mechanism 70 stops the flow of water from main shower head body 72. Turning on hot/cold faucet 58 enables water to enter main shower head body 72 through orifice 76 from main hot water supply line 20. Because push button mechanism 70 is in the closed position, the slug of cold water from hot water supply line 20 is contained within main shower head body 72 and directed by section sleeve 49 through vacuum control device 12 and diversion line 14 to containment device 18. As will be more fully described hereafter, once containment device 18 is full, push button mechanism 70 is operated and hot water from hot water supply line 20 will be almost instantaneously available at main shower head body 72.

Sleeve section 49 is shown surrounding flared end 48 but extending beyond flared end 48 and spaced apart from diversion line 14 and flared end 48 so that water flows within sleeve section 49 and over flared end 48. The inventor has determined that sleeve section 49 enhances the venturi effect caused by water flowing past flared end 48 to an outlet.

Figure 7:
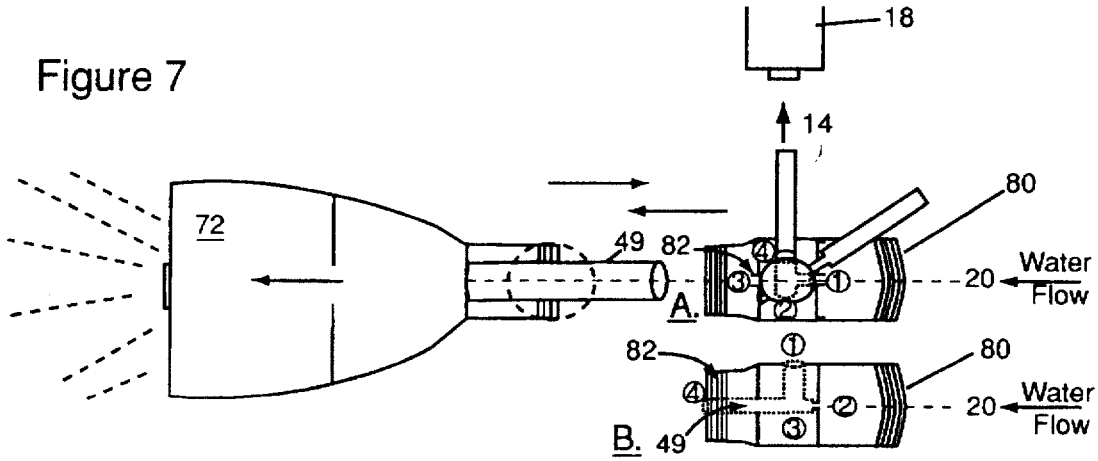
FIG. 7 is a side view of another preferred embodiment of the present invention.
Figure 8:
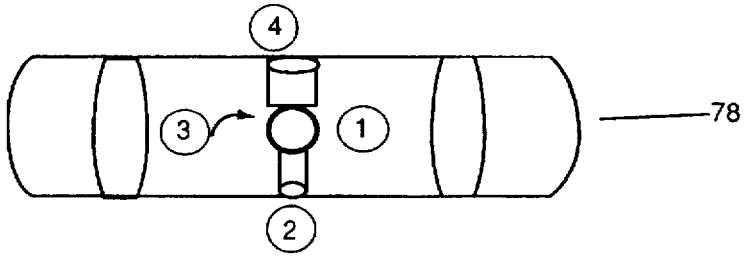
FIG. 8 is a side view of an armature for use with the invention shown in FIG. 7.

Referring to FIGS. 7 and 8, the regulating valve 16 and the vacuum flow device 12 are shown, by example, to be a functioning part of a rotating brass armature 78. The armature 78 is a brass cylinder, machined to slide snugly into a standard 1/2" threaded valve enclosure apparatus 80, typical of the "on-off" stop flow water valves available on the open market today. In this embodiment, the Tee fitting 40 has been reduced both in scale and concept, and has been moved inside the rotating armature 78. Depending on the selection position chosen, the rotating "tee" inside the armature becomes the regulator valve 16 in position #1, the vacuum control valve 12 in position #2, and completely stops incoming flow in position #3. When placed in position #1, the incoming flow 20 is routed to diversion line 14 to fill the containment cylinder 18. Upon filling containment cylinder 18 to capacity, the armature 78 is rotated to position #2, and the device becomes the vacuum flow device 12, evacuating containment cylinder 18 through diversion line 14 and mixing the cooled hot water with the main shower stream. Section sleeve 49 is positioned to receive the burst of pressurized water, given that it is fitted up against the opening to the outlet chamber 82 of the valve enclosure apparatus 80 in order to slide internally into its cylindrical orifice and provide a tight fit. At this connection point and with pressurized water flowing through the section sleeve 49 to the showerhead 72, the integrity of the venturi effect is maintained.

In operation, the pressure regulated diverting system for water conservation 10 of the present invention is utilized as follows. In the typical use situation, for example morning shower and shave, water in main hot water supply line 20 will have cooled over night. Referring to FIG. 1, a user operates switch 32 which may be electrical (as shown) or pneumatic (not shown) or manual as illustrated in FIGS. 3 and 6 and discussed more fully hereafter. Assuming switch 32 is electrical, when the switch is energized it causes regulating valve 16 to open so that water in diversion line 14 is free to pass through regulating valve 16 and into containment device 18. As shown in FIG. 2, water enters flared end 48 of diversion line 14 in the direction of arrow 54. This draws water from hot water supply line 20 and 22 to remove a slug of water that has cooled from the hot water supply line and fill containment device 18 shown in FIG. 1. In a preferred embodiment, containment device 18 is a cylinder approximately 15" tall by 10" in diameter and contains approximately 5 gallons of water.

Once containment device 18 is full of water, a seading device in a preferred embodiment a ping-pong ball (not shown) which is allowed to float within containment device 18, seals air vent 36. That is, as containment device 18 fills it raises the ping-pong ball until it is pressed firmly against automatic air vent 36 and seals the entire system against further water ingress. At this point the pressure in hot water supply lines 20 and 22 and diversion line 14 are equal. Operating hot water faucet 28 then substantially immediately, within two seconds or so, results in fresh hot water from hot water heater (not shown) to be delivered to the faucet 28 in the sink 26. As hot water flows in hot water supply line 22 for showering and other faucets and so forth, water passes over flared end 48 of diversion line 14 causing a negative pressure to result at point 51 as indicated in FIG. 2. This results in a suction of water from containment device 18 and mixture of this cooled hot water with the fresh hot water in hot water supply lines 20 and 22. While this is occurring, the mixture of the waters in the domestic water supply under pressure, ambient outside air is also being added. By so doing, any stream of water can be purposefully lowered in flow rate, but will appear to increase its delivery power, so as to give the general appearance and feel of a more powerful flow of water being delivered. The Applicant has determined that the water actually is delivered harder in the shower of the present invention at a flow rate of 2.0 gallons per minute, when "atomized" as described above, than it does when allowed to flow at 2.5 gallons per minute, un-atomized. Should this be a desired addition, the only change required is to prevent the complete sealing of the containment device 18 when emptied, thereby allowing ambient outside air to be introduced in the flow so long as the fixture is operated. Normally, however, as containment device 18 empties, the ping-pong ball (not shown) is ultimately sucked up against the connection of diversion line 14 with containment device 18 and seals it in its emptied state. At that point, float switch 38 sends a signal to regulating valve 16 that containment device 18 is empty and regulating valve 16 is closed and ready for use once again. As a result, the cooled hot water slug has been removed from the line, hot water made available directly at the faucet or shower head, and then the cooled slug of water is reintroduced and effectively utilized without waste.

Referring to FIG. 3, the operation of this preferred embodiment of the invention requires the activation of regulating valve 16 (a manual open/shut valve as illustrated in FIG. 3) to the shut position. Next, the user operates hot/cold faucet 58 by turning it to the hot selection and turning it on. Water then flows in the direction of arrow 66 past hot/cold faucet 58 through vacuum flow device 12 and is stopped by regulating valve 16 so that water is then directed through diversion line 14 in the direction of arrow 66 to fill containment device 18. In a preferred embodiment containment device 18 located in the shower, is clear so that it is obvious when containment device 18 is full. Containment device 18 is sealed by a sealing device, again in a preferred embodiment a ping-pong ball (not shown) which rises and falls with the level of the water in containment device 18. At the point where containment device 18 is full, the pressure in the containment device 18, diversion line 14 and hot water supply line 20 are equalized. The two plus gallons of cooled hot water have been removed from the lines and the user then opens regulating valve 16 and hot water is delivered directly through nozzle 60. Vacuum flow device 12 operates in the same manner as previously described so that the flow of hot water through nozzle 60 creates a negative pressure and a suction on containment device 18 so that water, also assisted by gravity in this embodiment, is drawn from containment device 18 in the direction of arrow 68 and the cooled hot water is blended with the hot water and used and not wasted. It should be emphasized that containment device 18 functions in the down, or gravity "unaided" position as well. It should also be emphasized that both the vacuum flow device 12 and the regulating valve 16 can also be located within the shower head assembly itself. Referring to FIG. 6, placement of the regulating valve 16 is shown, by example, to be a single "on-off" push button 70 in the face plate cover for main shower head body 72, which restricts or blocks the egress of water at the shower head 72. Vacuum flow device 12 is configured into the shower head 72 itself by insertion of a copper or nylon section sleeve 49 of appropriate distance and dimension, so as to achieve the required venturi effect. All operations remain the same, as described above in the FIG. 3 embodiment.

The preferred embodiments disclosed in FIGS. 7 and 8 illustrate a compact brass armature 78 which incorporates a means of positioning the regulating valve 16 and the vacuum flow device 12 in a single unit. By drilling the armature 78 in the required Tee formation, and then rotating the armature as described above, the operation of the invention can be accomplished as previously described. That is, the slug of cold water can be removed by placing the armature in a position to syphon the slug into containment device 18. By simply rotating the armature 90°, the fixture can be turned on, and water is introduced that is at the desired warm temperature and syphoning begins from containment device 18. Moving the armature 78 to position 3, totally closes off the flow when use of the fixture is no longer desired.

While the water conservation system of the present invention has been disclosed in connection with a household use, it should be appreciated that the conservation system can be used in other environments as well including industrial, mobile homes, moveable campers and the like. Further, while the present invention has been disclosed in connection with the preferred embodiment thereof, it should be understood that there may be other embodiments which fall within the spirit and scope of the invention as defined by the following claims.

I claim:

1. In a water delivery system where both hot and cold water lines are separately available, a method of regulating the hot water line for water conservation comprising the steps of:

(a) inserting a vacuum flow device into a hot water supply line;

(b) connecting one end of a two-ended diversion line to the vacuum flow device;

(c) connecting a regulating valve to the other end of the diversion line;

(d) connecting a containment device to the regulating valve;

(e) opening the regulating valve so that water that has cooled in the hot water supply line over time, enters the diversion line and enters the containment device;

(f) filling the containment device with this cooled hot water until pressure in the diversion line equals pressure in the hot water supply line; and (g) opening a hot water outlet in the hot water supply line so that fresh hot water from a hot water heater is directly available at the hot water outlet.

2. The method of claim 1 wherein inserting a vacuum flow device in the hot water supply line further includes the steps of:

(a) connecting a Tee fitting in line with the hot water supply line, the Tee fitting having two aligned openings;

(b) providing a third opening in the Tee fitting, perpendicular to the two aligned openings, and connecting the third opening to the diversion line; and (c) conforming the diversion line to be smaller than, and fit in spaced apart relation within, the third opening and one of the two aligned openings.

3. The method of claim 2 wherein connecting a diversion line to the vacuum flow device further comprises the steps of:

(a) extending a short section of the diversion line within and beyond one of the two aligned openings in the Tee fitting; and (b) flaring an end of the short section and encasing it within a section sleeve of copper tubing or nylon polymer so that water flowing away from the hot water supply line and around and over the flared end creates a suction on the diversion line and water flowing toward the hot water supply enters the flared end of the diversion line.

4. The method of claim 3 wherein connecting a regulating valve to the other end of the diversion line further comprises the step of providing a manual on/off valve for directing cooled hot water to the diversion line.

5. The method of claim 4 wherein the step of connecting a containment device to the regulating valve further comprises the steps of:

(a) providing an air vent in the containment device; and (b) providing a sealing means for closing off the air vent once the container is full of cooled hot water.

6. The method of claim 5 further comprising the step of utilizing a ping-pong ball within the containment device so that as the containment device becomes full the ping-pong ball effectively seals the air vent when pressed against it by water pressure.

7. The method of claim 6 further comprising the step of providing a float switch in the containment device so that when the containment device is empty, a signal that the containment device is empty is sent to the regulating valve.

8. The apparatus of claim 7 further comprising the step of selecting a regulating valve from a group including electrical/mechanical valves and pneumatic valves.

9. The method of claim 3 further comprising the steps of:

(a) operating the outlet opening for a sufficient period of time until the containment device is emptied of cooled hot water by means of water flowing past the flared end of the short section of the diversion line so that a suction is created on the diversion line; and (b) once the container is empty, closing the regulating valve.

10. The method of claim 3 further comprising the step of attaching a sleeve section in spaced apart relation around the flared end and extending beyond the flared end.

11. In a water delivery system where both hot and cold water lines are separately available, a pressure regulated hot water line diverting apparatus for water conservation comprising:

(a) a vacuum flow device inserted into a hot water supply line;

(b) a diversion line, with two ends, connected on one end to the vacuum flow device;

(c) a regulating valve connected to the other end of the diversion line; and (d) a containment device connected to the regulating valve.

12. The apparatus of claim 11 wherein the vacuum flow device further comprises:

(a) a Tee fitting with two aligned openings connected in line with the hot water supply line;

(b) the Tee fitting having a third opening, perpendicular to the two aligned openings, connected to the diversion line; and (c) the diversion line conformed to be smaller than, and fit in spaced apart relation within, the third opening and one of the two aligned openings.

13. The apparatus of claim 12 wherein the diversion line further comprises:

(a) a short section extending in and beyond one of the two aligned openings in the Tee fitting; and (b) a flared end on the short section encased within a section sleeve of copper tubing or nylon polymer so that water flowing away from the hot water supply and around and over the flared end creates a suction on the diversion line and water flowing toward the hot water supply enters the flared end of the diversion line.

14. The apparatus of claim 13 wherein the regulating valve further comprises a manually operable valve for directing cooled hot water to the diversion line.

15. The apparatus of claim 14 wherein the containment device further comprises:

(a) an automatic air vent for allowing air to enter and escape the container; and (b) a sealing device for sealing the air vent when the container is full.

16. The apparatus of claim 15 wherein the sealing device comprises a ping-pong ball.

17. The apparatus of claim 15 wherein the container further comprises a float switch so that when the container is empty a signal that the container is empty is sent to the regulating valve.

18. The apparatus of claim 17 wherein the regulating valve is selected from one of a group including electrical/mechanical valves and pneumatically operated valves.

19. The apparatus of claim 13 further comprising a section sleeve surrounding the flared end in spaced apart relation and extending beyond the flared end.

20. In a water delivery system, a pressure regulated diverting apparatus for water conservation comprising:

(a) a moveable armature with a Tee shaped channel;

(b) a valve enclosure conformed to fit around said moveable armature;

(c) a diversion line, with two ends, connected to the valve enclosure;

(d) a containment device connected to the diversion line;

(e) a water supply line connected to the valve enclosure;

(f) a water outlet in the valve enclosure so that, by movement of the armature, water in the water supply line is directed to the containment device, the water outlet, or blocked from entry into the valve enclosure; and (g) a vacuum flow device for applying suction to the containment device formed by said moveable armature when the water in the water supply line is directed to the water outlet.

* * * * *